US005919067A

United States Patent [19]

Smith

[11] Patent Number: 5,919,067

[45] Date of Patent: Jul. 6, 1999

[54] MOUNTING BRACKET FOR DEPTH FINDER ON A TROLLING MOTOR

[76] Inventor: Frank J. Smith, 425 Dennis Dr., Shepherdsville, Ky. 40165

[21] Appl. No.: 08/891,658

[22] Filed: Jul. 11, 1997

[51] Int. Cl.[6] ..... B60L 1/14

[52] U.S. Cl. ..... 440/2; 440/6; 440/900; 114/343

[58] Field of Search ..... 440/2, 6, 7, 77, 440/78, 113, 900; 114/343, 364; 248/682, 674, 678, 176.1, 200, 218.4, 226.11, 230.6

[56] References Cited

U.S. PATENT DOCUMENTS 4,737,940 4/1988 Arringota .
4,784,624 11/1988 Yoshida et al. .
5,041,030 8/1991 Paunc, Sr. .
5,052,320 10/1991 Cremer ..... 440/900
5,186,428 2/1993 Falkenberg .
5,660,132 8/1997 Pasley ..... 440/6

*Primary Examiner*—Stephen Avila
*Attorney, Agent, or Firm*—Middleton & Reutlinger; John F. Salazar

[57] ABSTRACT

A mounting bracket for attachment of a depth finder view screen to a trolling motor column shaft is described. The attachment bracket is a combinable sleeve which fits over the column shaft and has an accurate support arm extending therefrom. The support arm elevates, at the opposite end, a base plate which receives screws or other devices through apertures therethrough and connects to the base of a depth finder view screen.

5 Claims, 2 Drawing Sheets

MOUNTING BRACKET FOR DEPTH FINDER ON A TROLLING MOTOR

BACKGROUND OF THE INVENTION

1. Field of the Invention

The present invention relates to mounting hardware for a depth finder view screen and other equipment for attachment of said equipment onto a trolling motor column shaft.

2. Discussion of the Prior Art

For utilization with a small boat or craft it is typical to provide a depth finder attached to the bottom of the craft for determining the depth of the water. Such devices can also be used for location of fish while fishing from the craft. These devices operate in a matter such as sonar systems reflecting sound waves off the bottom or any objects located in the water and measuring the reflection time differential of said waves. Difficulty however has arisen in attachment of said sonar systems and depth finders to a water craft and particularly to a trolling motor already affixed to said craft. Most notably, previous devices have been attached to their own support stands which are affixed to the water craft. Other devices have been known to attach a fish finder or depth detector for integration with an outboard engine. For example, U.S. Pat. No. 4,784,624 teaches a depth finder transmitter and receiver that is carried within the interior of an outboard engine said outboard engine pivotally supported to the craft. The depth finder is integrally molded and connected with the engine.

U.S. Pat. No. 4,737,940 teaches a trolling motor with a sonar transducer formed integrally within the trolling motor. Wiring and other connection device are attached through the shaft drive of the trolling motor. However, the sonar transducer and trolling motor must be manufactured as a single unit. None of these devices heretofore have provided a means for attachment of a separately purchased depth finder to a standard trolling motor device for easy addition to existing boat hardware.

SUMMARY OF THE INVENTION

It is therefore an object of the present invention to provide a means for mounting a standard depth finder to a generic trolling motor column shaft. It is a further object of the present invention to overcome the deficiencies of the prior art indicted above and, notably, remove the requirement of integral hardware required when connecting a depth finder screen to a boat engine or outboard trolling motor.

It is another object of the present invention to provide a mount for attaching a depth finder view screen onto a bracket which attaches thereto on a trolling motor column shaft.

It is a further object of the present invention to provide standard means for attaching the depth finder view screen and mounting bracket to variable size column shafts of a trolling motor.

Finally, the present invention comprises A trolling motor depth finder mount, comprising: a base plate, said base plate having a top and bottom side and having aperature formed therethrough; an arcuate arm having a first and second distal end, said first distal end connected to the bottom side of said base plate, said arcuate arm extending from a horizontal position at said first distal end to a vertical position at said second distal end; an attachment sleeve, said attachment sleeve comprised of a first semi-circular half and a second semi-circular half, said first and said second halves of said attachment sleeve combined together to form a vertical sleeve, said first half also having an outwardly extending horizontal receiving aperature which receives therein said second distal end of said arcuate support arm; said first and said second semi-circular halves of said sleeve affixed together by attachment means.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figures 1, 2:
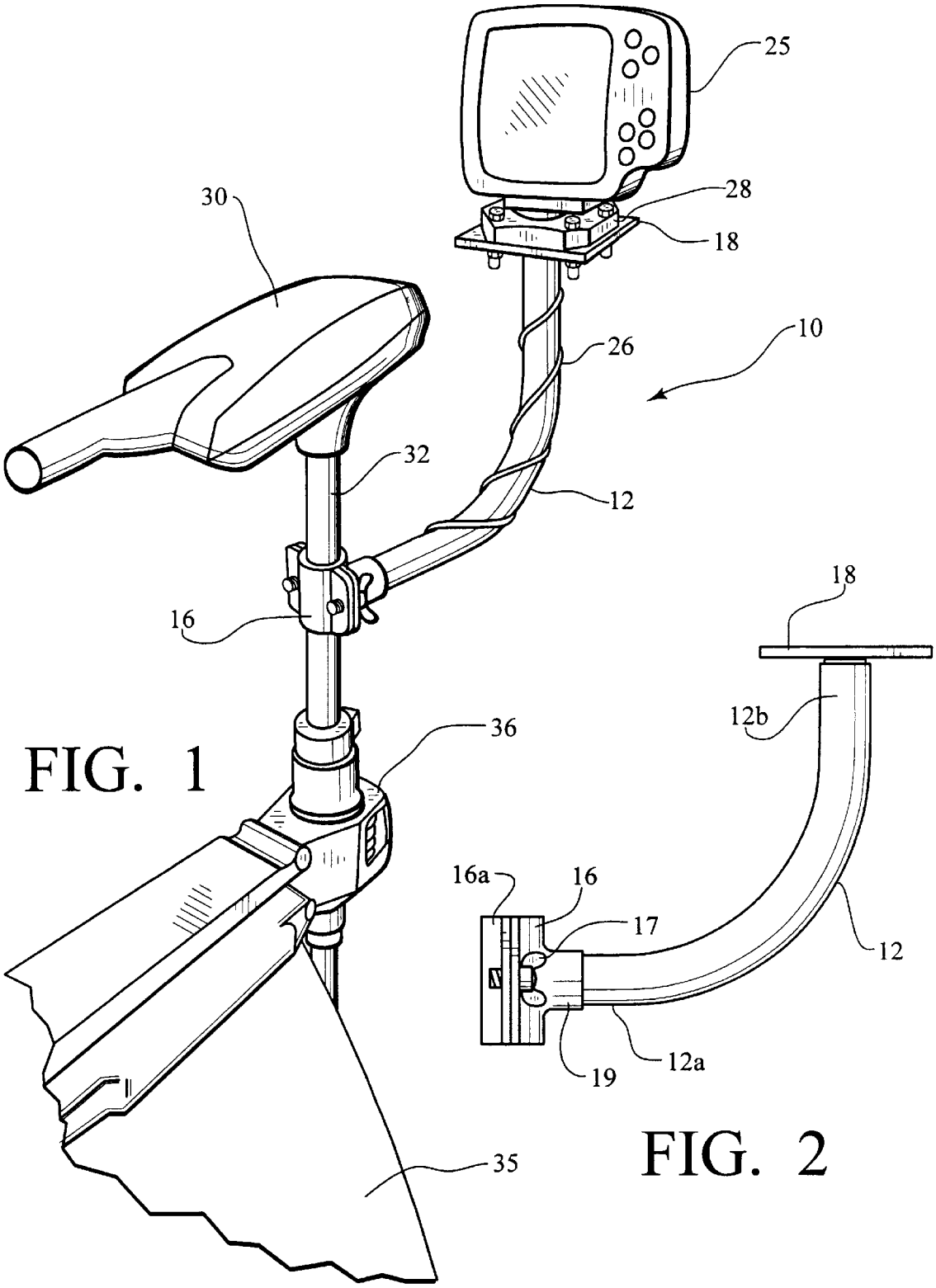
FIG. 1 is a perspective view of the depth finder and trolling motor bracket of the present invention wherein the view screen of the depth finder and trolling motor and boat are all shown.
FIG. 2 is a side view of the bracket shown in FIG. 1.

As shown in FIG. 1, the trolling motor depth finder mount 10 is connected to a column shaft 32. The mount 10 is attached at the lower end to trolling motor column shaft 32 via attachment sleeve 16. Depth finder viewing screen 25 is attached to mounting plate 18. Arcuate shaft or support arm 12 supports rectangular base 18 and holds the screen 25 in an upright angled position. Trolling motor column shaft 32 is attached to a boat 35 via standard trolling motor attachment hardware 36 through which extends column shaft 32. Column shaft 32 is a standard metallic or hard plastic cylindrical shielding material covering the trolling motor column shaft mechanics.

Arcuate support arm 12 is shown more clearly in FIG. 2 wherein base plate 18 and attachment sleeve 16 are clearly shown. Arcuate support arm 12 raises the level of the depth finder view screen 25 to an appropriate visual height. The total length of support arm 12 may be 10 inches in total linear length. Support arm 12 extends outward from a horizontal plane at end 12*a* through a curvature in the center portion to a substantially vertical end 12*b*. A full 90 degree angle is thereby provided between attachment at one end to the other, however varying angles may be provided dependant upon users requirements or on the particular hardware involved. Also shown in FIG. 2 is the attachment sleeve 16. View finder screen 25 has wiring 26 which may be required to connect to a transducer located below the boat 35. Such wiring may be wound around arcuate support arm 12 as shown in the referenced figure.

Shown in FIG. 1, 2, 3 and 4 is attachment sleeve 16 which is designed to tighten around various diameter trolling motor column shafts 32. Shown in FIGS. 3 and 4, attachment sleeve 16 is actually comprised of double sections, said first section being half portion 16 and opposite half portion 16*a*. When combined together both semi-circular portions of the attachment sleeve squeeze together around column shaft 32 and may be tightened thereon by wing nut 17 and 17*a*. Column shaft 32 for the trolling motor 30 may be of variable diameter, said diameter typically ranging from 1 inch to 2.25 inches. By bi-secting or severing attachments sleeve 16 axially down the center portion and forming into two separate hemispheres 16 and 16*a*, attachment sleeve 16 may be adjustable to multiple diameter column shafts 32. Wing nut 17 and 17*a,* as are shown in the drawings, may actually be any adhesive or attachment means for both hemispheres, wing nuts being only one example. Additionally, shown in FIG. 3 and FIG. 4 two wing nuts 17 and 17*a* are shown. However different embodiments may incorporate up to 4 threaded screws, two extending through rectangular plate 19*a* and 19*b* and an additional two extending through 19*c* and 19*d*. Attachment sleeve portion 16 and 16*a* which receives arcuate support arm 12 into horizontal aperture 19, may be made of any hard or stiffened material such as a thermoplastic, pvc or possibly a metal in material. The material of choice is a thermoplastic material because of the ease of use, ease of manufacture and low cost.

Figure 3:
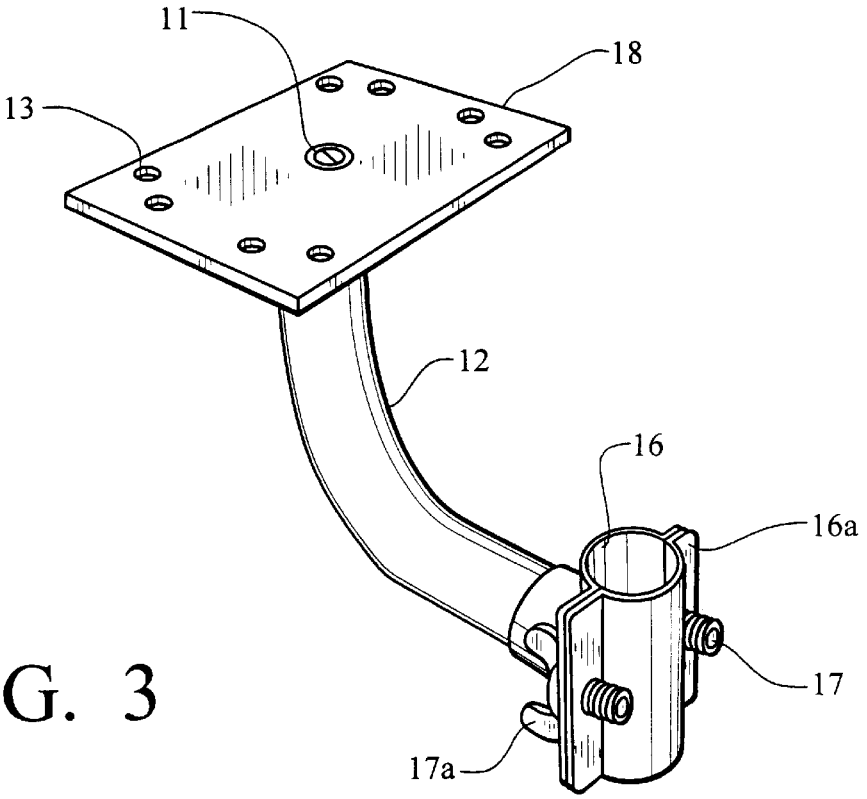
FIG. 3 is a prospective side view of the attachment bracket of the present invention.
Figure 4:
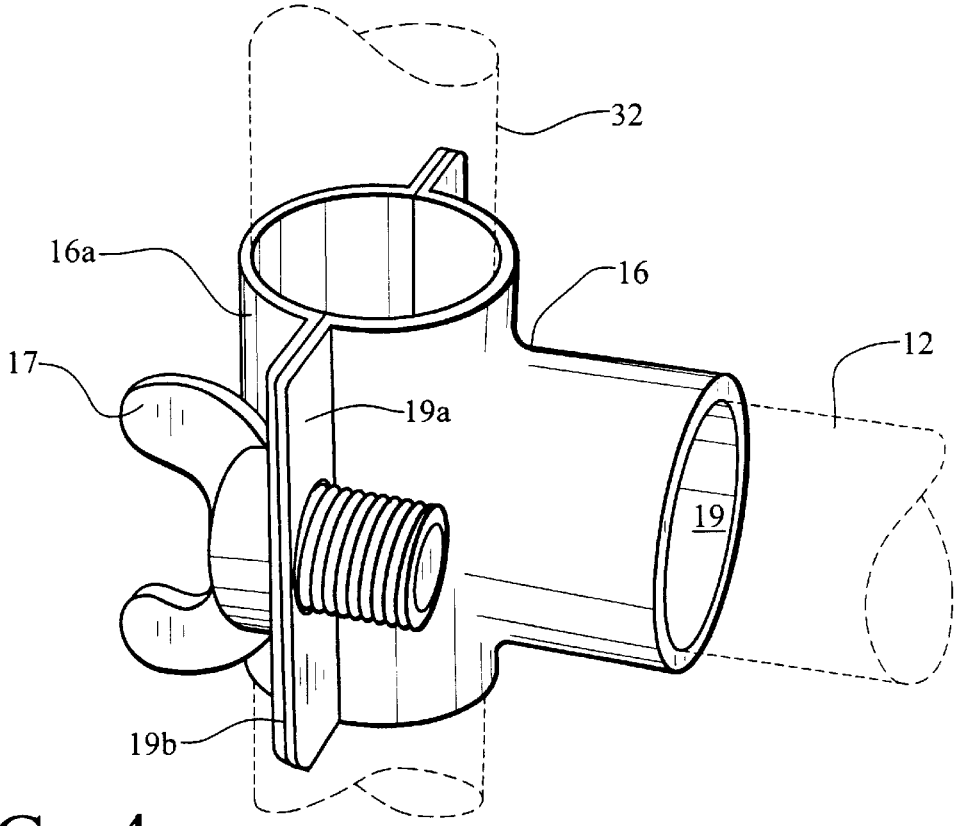
FIG. 4 is a prospective view of the attachment collar for attaching the bracket shown in FIG. 1 to a trolling motor column shaft.

Shown in FIG. 3, support base plate 18 is held at the opposite end of arcuate support arm 12 and attached thereto by threaded screw 11. Support plate 18 has a plurality of aperture or holes 13 formed thereon for receiving screws or bolts which extend downward through the base of depth finder view screen 25. View scree base 28 has differing locations for screws to attach it and variable locations for the apertures 13 are on support 18 provided for differing designs of view screen bases 28. Ideally, multiple screws will be used to hold the screen 25 to support 18 such that it is firmly attached thereto. In the side view shown in FIG. 2, support plate 18 is in an horizontal position. However, arcuate arm 12 or the support plate 18 itself may be situated such that plate 18 is held at an upward angle to provide for easy viewing by the user who may be standing at an upward angle above. Plate 18 is also shown in FIG. 3 as being attached to arcuate arm 12 via threaded screw 11. This may be accomplished by utilizing a small threaded piece which extends into the arcuate arm which may be hollow and which has a threaded bore formed centrally therein. Screw 11 thereby will extend downward through an opening in base plate 18 and into the piece held within arcuate arm 12. Alternatively, different forms of affixation for the base plate 18 to the arcuate arm 12 may be provided such as adhesives or other retaining means. The base plate 18 may, in the preferable embodiment, be molded as a single piece with the arcuate arm 12 such that no attachment hardware is needed.

When used in combination with a trolling motor 30, the depth finder support brace allows for easy attachment of a view finder screen 25 to variable size trolling motors 30 and column shaft 32. Heretofore, it has been difficult to provide a means to affix a view finder 25 specifically to a trolling motor. Mounting bracket 10 hereby solves that problem by securely affixing the monitor 25 to various diameter column shafts 32 via an arcuate arm 12. It will be apparent from the foregoing description of preferred embodiment of the invention that many modifications can be made to the embodiments described without departing from the spirit and the scope of the invention.

Support base 18, arcuate arm 12, and sleeve 16*a* and 16 may all be made of a hardened plastic material or thermo plastic or may alternatively be comprised of aluminum or other light weight metal. Plastic however would be the material of choice because of its lightweight nature and low cost in manufacturing.

What is claimed is:

1. A trolling motor depth finder mount, comprising:

a base plate, said base plate having a top and bottom side and having aperture formed therethrough;

an arcuate arm having a first and second distal end, said first distal end connected to the bottom side of said base plate, said arcuate arm extending from a horizontal position at said first distal end to a vertical position at said second distal end;

an attachment sleeve, said attachment sleeve comprised of a first semi-circular half and a second semi-circular half, said first and said second halves of said attachment sleeve combined together to form a vertical sleeve, said first half also having an outwardly extending horizontal receiving aperture which receives therein said second distal end of said arcuate support arm;

said first and said second semi-circular halves of said sleeve affixed together by attachment means;

wherein said base plate is attached to said arcuate support arm by a threaded attachment screw.

2. A trolling motor depth finder mount, comprising:

a base plate, said base plate having a top and bottom side and having aperture formed therethrough;

an arcuate arm having a first and second distal end, said first distal end connected to the bottom side of said base plate, said arcuate arm extending from a horizontal position at said first distal end to a vertical position at said second distal end;

an attachment sleeve, said attachment sleeve comprised of a first semi-circular half and a second semi-circular half, said first and said second halves of said attachment sleeve combined together to form a vertical sleeve, said first half also having an outwardly extending horizontal receiving aperture which receives therein said second distal end of said arcuate support arm;

said first and said second semi-circular halves of said sleeve affixed together by attachment means;

wherein said plurality of apertures formed in said base plate are eight aperture formed in semi-circular fashion through said base plate.

3. A trolling motor depth finder mount, comprising:

a base plate, said base plate having a top and bottom side and having aperture formed therethrough;

an arcuate arm having a first and second distal end, said first distal end connected to the bottom side of said base plate, said arcuate arm extending from a horizontal position at said first distal end to a vertical position at said second distal end;

an attachment sleeve, said attachment sleeve comprised of a first semi-circular half and a second semi-circular half, said first and said second halves of said attachment sleeve combined together to form a vertical sleeve, said first half also having an outwardly extending horizontal receiving aperture which receives therein said second distal end of said arcuate support arm;

said first and said second semi-circular halves of said sleeve affixed together by attachment means;

wherein said base plate is attached to said arcuate support arm at an upward angle.

4. In combination with a trolling motor, said trolling motor having a column shaft, a trolling motor depth finder mount comprising:

a first and a second semicircular attachment sleeves securely affixed to said trolling motor column shaft, said second semi-circular attachment sleeve having a horizontally extending receiving aperture extending outward therefrom;

an arcuate support arm having a first and second distal end, said first distal end extending into said horizontally extending aperture of said attachment sleeve;

a support base having a top and bottom side, said bottom side affixed to said second distal end of said arcuate support arm;

wherein said base plate is attached to said arcuate support arm by a threaded attachment screw.

5. In combination with a trolling motor, said trolling motor having a column shaft, a trolling motor depth finder mount comprising:

a first and a second semicircular attachment sleeves securely affixed to said trolling motor column shaft, said second semi-circular attachment sleeve having a horizontally extending receiving aperture extending outward therefrom;

an arcuate support arm having a first and second distal end, said first distal end extending into said horizontally extending aperture of said attachment sleeve;

a support base having a top and bottom side, said bottom side affixed to said second distal end of said arcuate support arm;

wherein said base plate has a plurality of apertures formed therethrough.

* * * * *